US007194772B2

(12) United States Patent
Rie

(10) Patent No.: US 7,194,772 B2
(45) Date of Patent: Mar. 27, 2007

(54) REVERSE SITTING COMMODE

(76) Inventor: Jin Rie, 110 N. Berendo St. #4, Los Angeles, CA (US) 90004

( * ) Notice: Subject to any disclaimer, the term of this patent is extended or adjusted under 35 U.S.C. 154(b) by 330 days.

(21) Appl. No.: 11/022,412

(22) Filed: Dec. 27, 2004

(65) Prior Publication Data

US 2006/0137082 A1 Jun. 29, 2006

(51) Int. Cl.
*E03D 11/00* (2006.01)

(52) U.S. Cl. ..... 4/254; 4/420; 4/353

(58) Field of Classification Search ..... 4/254, 4/300, 353, 420

See application file for complete search history.

(56) References Cited

U.S. PATENT DOCUMENTS 4,012,797 A * 3/1977 Kristoffersen ..... 4/300

FOREIGN PATENT DOCUMENTS

JP 6-304092 * 11/1994

* cited by examiner

*Primary Examiner*—Charles E. Phillips

(57) ABSTRACT

A commode chair with reversed seat facing a water tank is provided. The seat assembly including bowl, seat, and lid are formed to support a user to sit on a commode facing the water tank. The seating assembly has a narrow width to the direction of a water tank and has wider width on the opposite side. An overview of the seating assembly has a shape of an oval facing the water tank with the sharp end, a bicycle saddle, facing the water tank. The water tank is leaned backwards in relation to the commode to allow a user to rest his/her upper body thereon. This sitting position reduces pressure build up of the lower body of the user around the commode seat and provides a convenient and more compatible resting time.

3 Claims, 5 Drawing Sheets

REVERSE SITTING COMMODE

BACKGROUND OF THE INVENTION

When a user sits on a normal commode, the water tank is always placed behind the user and all of the user's weight is supported by a narrow area that is the seating assembly of the commode. Therefore, the pressure build up in the user's lower body is more than negligible. Extended sitting—over 15 minutes—on a normal commode creates pain to the user's lower body along the contact area with the seat. For an overweight user or a user who suffers from constipation and hemorrhoids, these normal commodes provide great pain. Some commodes are modified to support patients who have difficulty in moving. However, those modified commodes do not eliminate the inconvenience for the users who suffer from such aforementioned ailments. It is the purpose of the current application to provide a commode that provides a convenient and compatible resting time not only to the users who are suffering from the ailments mentioned above but also to all other users.

1. Field of the Invention

Current application relates to a combination of a commode chair and a water tank, more particularly, to a new commode chair with enhanced user support for reducing pressure concentration points on the lower body of a user while providing enhanced support of the upper body of the user.

2. Description of the Prior Art

U.S. Pat. No. 6,324,705 to Zephier illustrates a commode chair with enhanced user support for reducing pressure concentration points on the body of the user while providing enhanced support of the body of the user. The commode chair includes a commode chair for enhancing sitting comfort on a commode, and which includes a seat assembly, a support assembly, and a bladder. The seat assembly supports the buttocks of a user, and comprises a platform having an upper surface and a lower surface. The support assembly is mounted on the platform assembly for engaging an upper rim portion of the bowl portion of a commode.

U.S. Pat. No. 5,996,133 to Fletcher illustrates a toilet aid, for use on an ordinary water closet/toilet fitted with an ordinary lift up toilet seat, which aid comprises an overseat supported on an annular or part annular pneumatically inflatable bag assembly, and is characterized in that flexible locating means is attached to a bottom part of the bag assembly so as to be foldable or bendable to extend beneath the toilet seat to locate the bag assembly on the toilet seat for pneumatically raising and lowering the overseat relative thereto.

U.S. Pat. No. 5,329,645 to Fossum, et al. illustrates a device for providing support for a user seated on a commode and comprising a substantially U-shaped framework attached to a wall behind the commode includes a pair of elongated horizontal members joined by a crossbar and having legs at its forward corners. The framework is rotated through substantially 90. degree, to rest with its legs on the floor in front of the commode. A padded tray is slidably mounted on and rotatable with the horizontal members of the framework and is moved closely adjacent to the user when the user is seated on the commode. When not in use, the device is rotated upward, folded against the wall, and secured to the wall by a clip. The device is preferably made of polyvinyl chloride pipe and the tray is covered with a sheet of plastic material.

U.S. Pat. No. 4,777,671 to Kearns illustrates toilet seat assembly is provided having a seat that is pivotably supported at its forward end for swinging movement between substantially horizontal and upwardly inclined positions. A power lift mechanism is incorporated in the assembly and is selectively operable by the user to pivot the seat and support the seat in a desired position for assisting the user in moving between seated and standing positions. The power lift mechanism includes an expandible bladder of the bellows disposed at the rear of the seat assembly between a base structure adapted to be secured on the top of a toilet bowl and the pivoted seat that is also mounted on the base structure. A fluid control system is coupled with the expandible bladder and adapted to be connected with a source of pressurized fluid and has a manually actuated control valve operable by the user to permit admission of pressurized fluid into the bladder to cause its expansion and upward pivoting of the seat or to permit outflow of fluid from the bladder resulting in construction of the bladder and pivoting of the seat towards a horizontal position.

None of the prior art illustrates a commode that can reduce the pressure build up in the lower body of the user drastically by resting the whole upper body of the user on the water tank.

SUMMARY OF THE INVENTION

The general purpose of the current application is to provide a new commode chair with enhanced user support generated by a leaned water tank. Many of the advantages of the commode chair of the current application and many novel features that result in a new commode chair with enhanced user support is not anticipated, rendered obvious, suggested, or even implied by any of the prior art commode chairs, either alone or in any combination thereof.

To attain this, the present invention generally comprises a commode chair for enhancing sitting comfort on a commode, including a seat assembly and a water tank. The seat assembly supports the buttocks of a user, and comprises a platform having an upper surface and a lower surface. A commode chair with reversed seat facing a water tank is provided. The water tank supports the user for reducing pressure build up on the body. The seat assembly including bowl, seat, and lid are formed to support a user to sit on a commode facing the water tank. The seating assembly has a narrower width on the side closest to the water tank and has a wider width on the opposite side. An over view of the seating assembly has a shape of an oval facing the water tank with the sharp end. The water tank is leaned backwards on the commode to allow a user to lean his/her upper body against thereon. This sitting position reduces the pressure build up at the lower body of a user around the commode seat and provides a convenient resting time.

DETAILED DESCRIPTION OF THE PREFERRED EMBODIMENT

Figure 1:
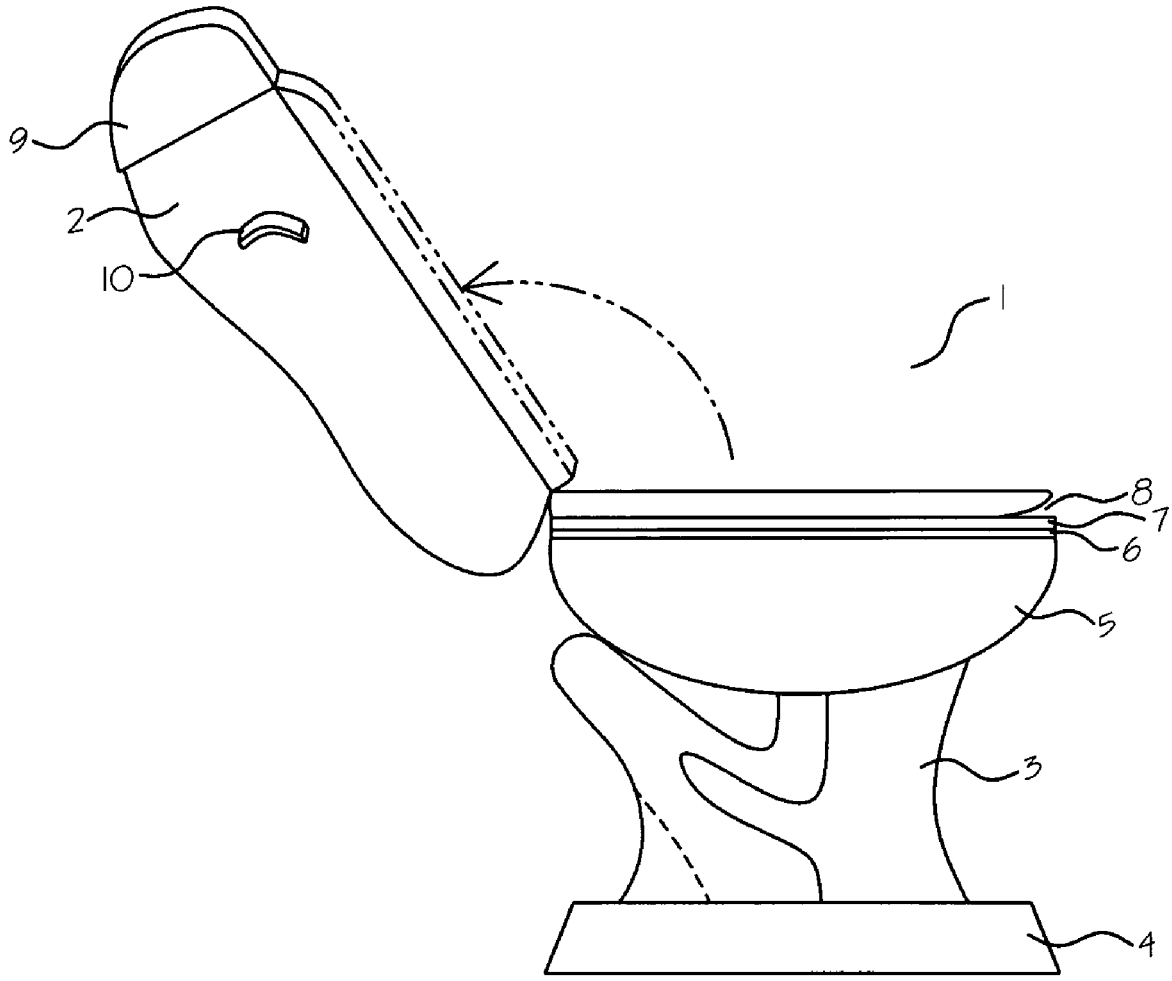
FIG. 1 is a side view of the reverse sitting commode of the current application.

FIG. 1 is a side view of the reverse sitting commode (1) of the current application. The reverse sitting commode (1) is comprised of a water tank (2), a base (3), a base plate (4), a bowl (5), a bowl lip (6), a seat (7) and a seat lid (8). As shown in the FIG. 1, the water tank (2) is leaned to or tilted the opposite direction of the bowl (5). The water tank being tilted in an orientation away from vertical such that an axis thereof will meet a longitudinal axis of the bowl in an obtuse angle in order for the tank to lend support to a user's upper torso while the user is seated upon said bowl. The over all shape is smoothly rounded. When a user sits on the commode (1), the seat lid (8) is fully opened and leaned towards the water tank (2). The lower surface of the seat lid (8) is rounded to meet the user's stomach when it is fully opened and leaned on the water tank (2). The surface of the water tank (2) is covered with one of a soft material such as artificial fur made of polyester, natural animal fur, artificial leather made of polyurethane, animal leather, silicon rubber or cotton. Surface of the water tank is covered with one material mentioned above or a combination of the above mentioned materials. The thickness of the surface covered material is at least 1 centimeter to 10 centimeter to make the water tank feel like a human body. The water tank (2) is covered with one of the soft materials with 10 centimeters designated for a ladies commode for the softness of the water tank (2). The top of the water tank has a cover (9) that has a rounded upper surface. A flushing lever (10) is found at the side of the water tank (2) as is conventional.

Figure 2:
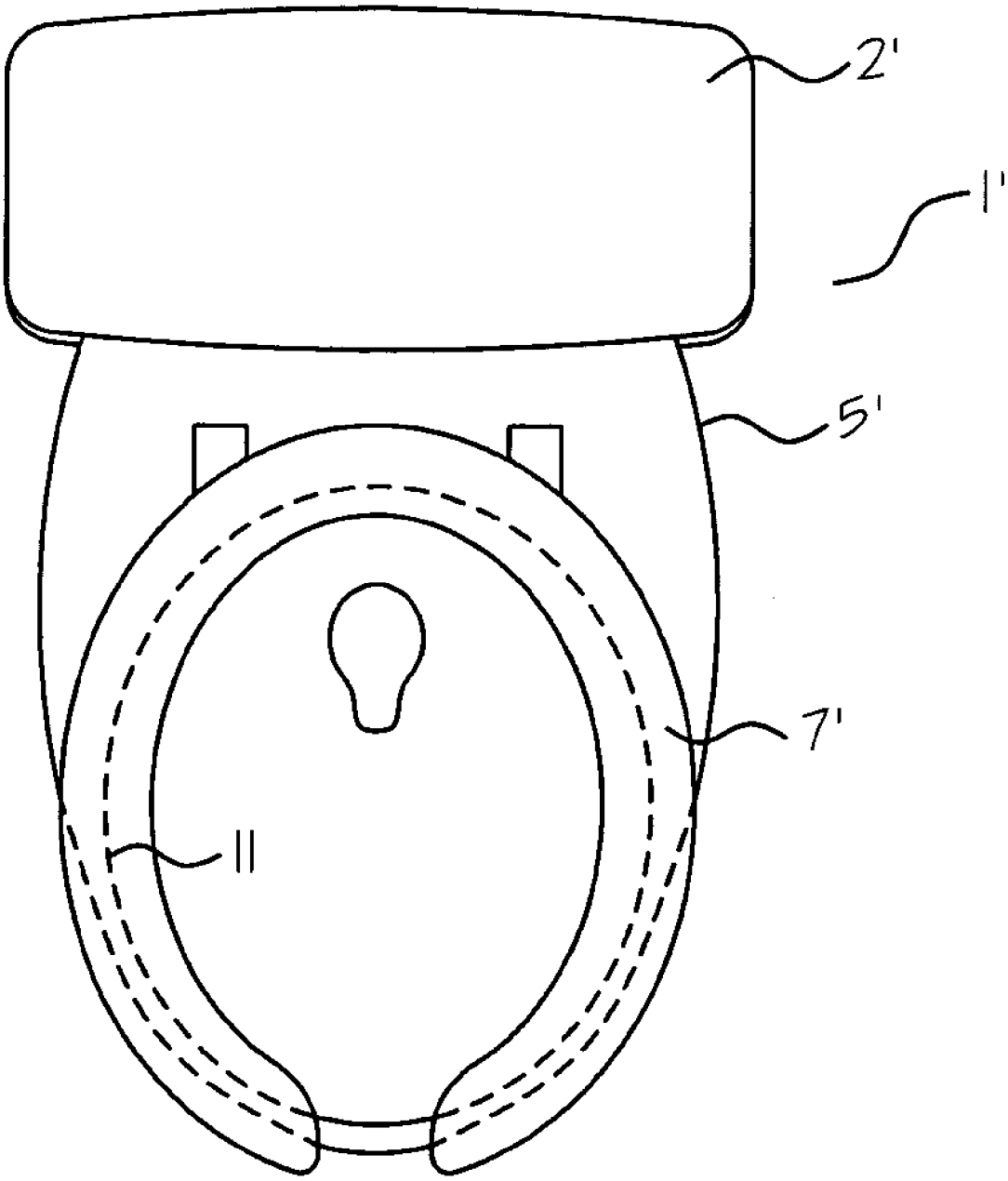
FIG.2 Prior Art
FIG. 2 is an over view of a conventional commode of the prior arts.

FIG. 2 is an over view of conventional commode of the prior art. The shape of the upper part of the bowl (5') itself is an oval whose narrow end is flat and connected to the water tank (2'). However, the bowl's opening (11) and the seat (7') are developed reversely, in other words, the side closest to the water tank (2') is wider and the other side is narrower. This shape is created to match the shape of a human body's lower bottom when sitting on a commode.

Figure 3:
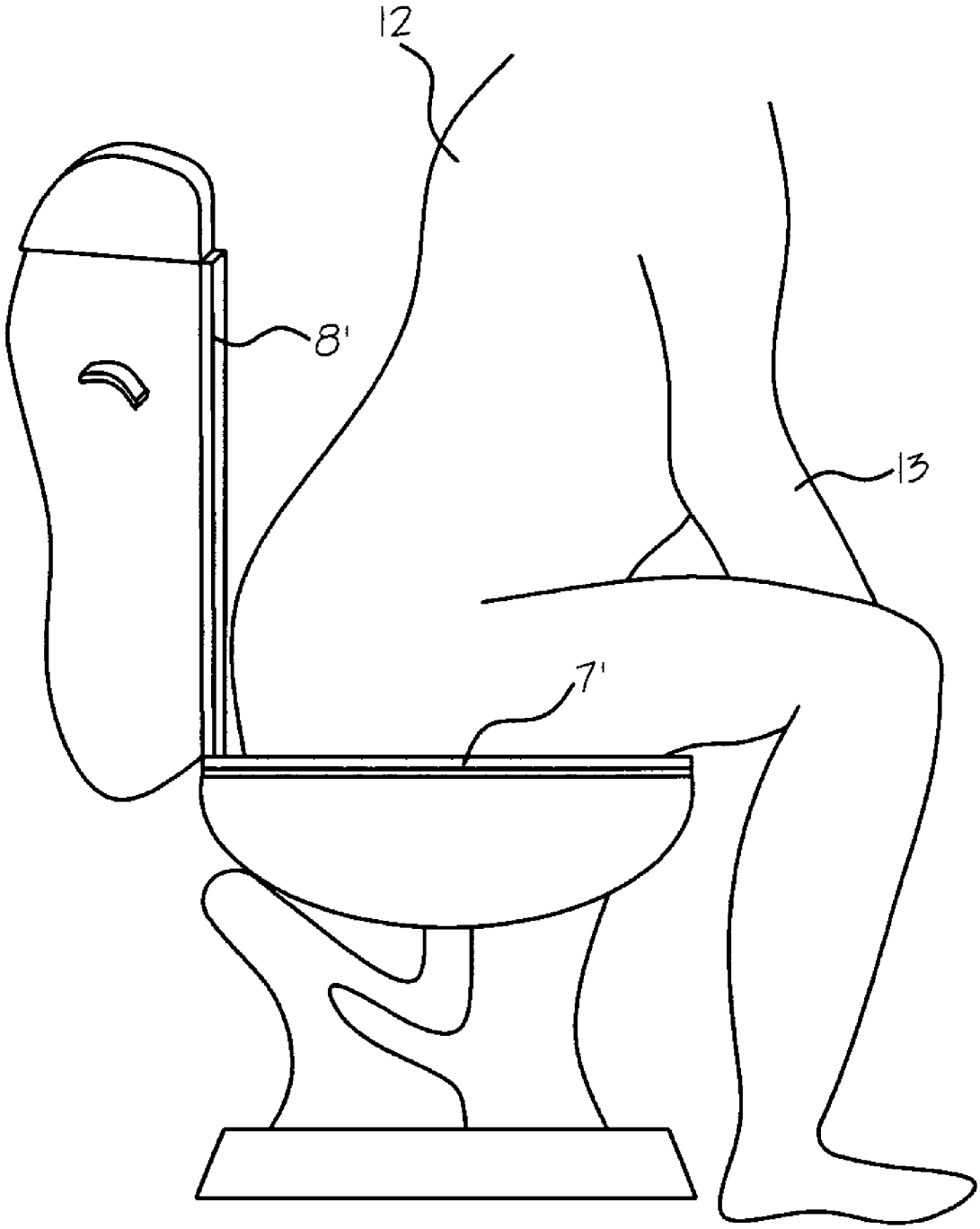
FIG.3 Prior Art
FIG. 3 is a schematic drawing of a user sitting on the conventional commode of the prior art.

FIG. 3 is a schematic drawing of a user (12) sitting on the conventional commode (1') of the prior art. When a user (12) sits on this commode (1'), all the body weight is concentrated to the contacting area with the seat (7') because a user usually leans forward and put his/her arms (13) on/between the thighs. An extended stay in this position has as variety of negative effects, including making the legs numb.

Figure 4:
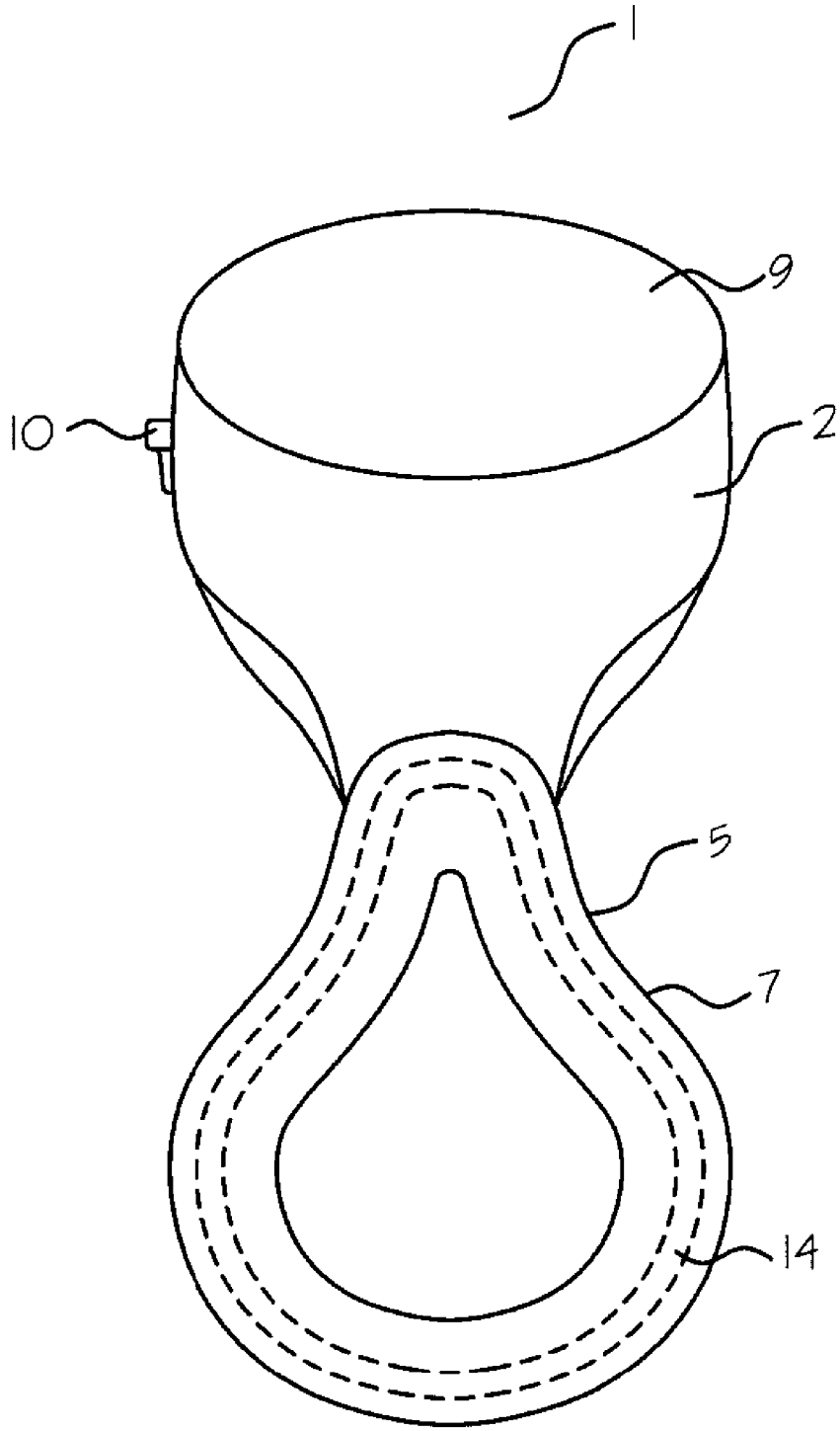
FIG. 4 is an over view of the reverse sitting commode of the current application without sit lid.
Figure 5:
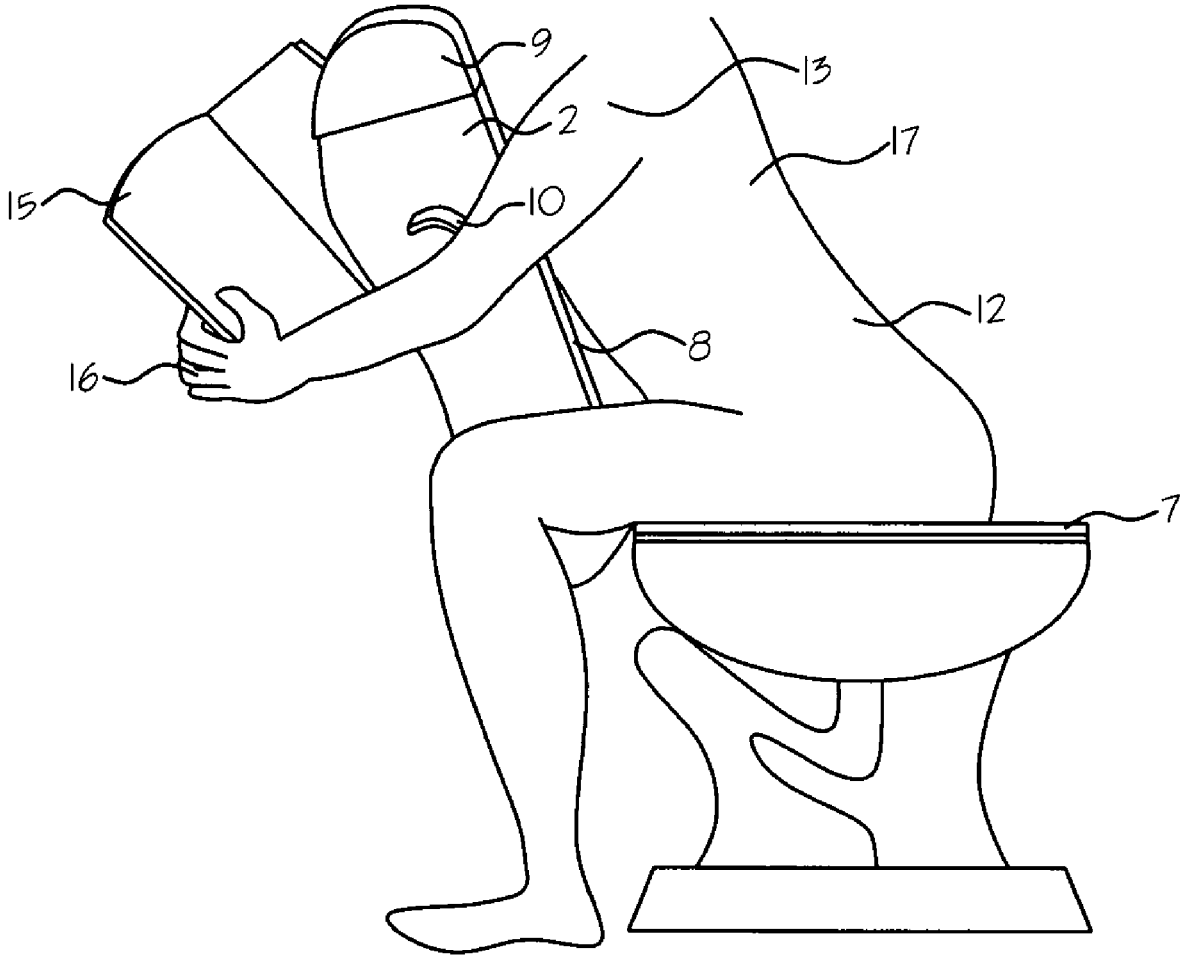
FIG. 5 is a schematic drawing of a user sitting on the commode of the current application.

FIG. 4 is an over view of the reverse sitting commode (1) of the current application without a seat lid. The seat lid is not shown to make it simple. The shape of the upper part of the bowl (5) itself is a saddle of a bicycle whose narrow end is flat and connected to the water tank (2). The seat (7) and the mouth (14) of the bowl (5) is developed match to the bowl (5) shape, in other words, the side closest to the water tank (2) is narrower and the other side is wider. That shape is to match the shape of a human body's lower bottom when sitting on a commode facing the water tank. FIG. 5 is a schematic drawing of an user (12) sitting on the commode (1) of the current application. With this position the hands (16) and arms (13) of the user are naturally placed on the upper surface of the water tank or hug the water tank while the upper body leans on the water tank. The user can read articles (15) behind the water tank (2) while leaning his head over the water tank (2). Therefore, the commode (1) of the current application is located at least 50 centimeter from the wall. With this position, the weight of the upper body (17) of the user (12) of the current application is rested on the water tank (2) and as a result the pressure built up to the lower part of the user (12) along the seat (7) of the commode (1) of the current application is drastically reduced. If the user totally leans on the water tank (2), he/she can sit on the commode of the current application much longer than the commodes of the prior art. The commode (1) of the current application will reduce the pains from an overweight user and a user who suffers from constipation and hemorrhoids.

Even after using the commode (1), the user need not to turn around to operate the flushing lever (10).

What is claimed is:

1. A reverse seating commode comprising a toilet bowl and a water tank, said water tank being tilted in an orientation away from vertical such that an axis thereof will meet a longitudinal axis of said bowl in an obtuse angle in order for said tank to lend support to a user's upper torso while said user is seated upon said bowl, a seat mounted on said bowl, said seat and bowl being narrow at a portion proximal to said tank and wider at a portion distal to said tank so as to accommodate a user seated thereon facing said tank.

2. A commode chair with a reversed seat facing a water tank in claim 1, wherein the water tank is covered with one of a soft material such as artificial fur made of polyester, natural animal fur, artificial leather made of polyurethane, animal leather, silicon rubber or cotton.

3. A commode chair with a reversed seat facing a water tank in claim 1, wherein the water tank is covered with a soft material with a thickness of over 1 centimeter.

* * * * *